US005952923A

United States Patent [19]

Sach

[11] Patent Number: 5,952,923

[45] Date of Patent: Sep. 14, 1999

[54] APPARATUS AND METHOD FOR MAGNETISING SECURITY TARGETS

[75] Inventor: Martin Robert Sach, Codicote, United Kingdom

[73] Assignee: ALS International Limited, United Kingdom

[21] Appl. No.: 08/908,705

[22] Filed: Aug. 8, 1997

[30] Foreign Application Priority Data

Aug. 8, 1996 [GB] United Kingdom ..... 9616615

[51] Int. Cl.[6] ..... G08B 13/14

[52] U.S. Cl. ..... 340/572.6; 325/284

[58] Field of Search ..... 340/572.6, 551; 335/284

[56] References Cited

U.S. PATENT DOCUMENTS

| | | | |
|---|---|---|---|
| 4,249,167 | 2/1981 | Purinton et al. | 340/572 |
| 5,126,720 | 6/1992 | Zhou et al. | 340/572 |
| 5,151,843 | 9/1992 | Sanetra et al. | 361/149 |
| 5,410,296 | 4/1995 | Montbriand et al. | 340/572 |
| 5,500,640 | 3/1996 | Zhou et al. | 340/572 |
| 5,521,583 | 5/1996 | Frahm et al. | 340/551 |

FOREIGN PATENT DOCUMENTS

| | | | |
|---|---|---|---|
| 0134404 | 3/1985 | European Pat. Off. . | |
| 533139 | 3/1993 | European Pat. Off. | 340/551 |
| 2720538 | 5/1994 | France . | |
| 1171957 | 11/1969 | United Kingdom . | |
| 08177 | 3/1995 | WIPO . | |
| 21207 | 6/1996 | WIPO . | |

*Primary Examiner*—Thomas Mullen
*Attorney, Agent, or Firm*—Galgano & Burke

[57] ABSTRACT

In one aspect the purpose of the apparatus is to create a magnetic field suitable for the conditioning of security targets composed small spring steel strips with a long permalloy backing of the type normally used in library books. This apparatus includes a row of coils which are energized progressively along the row in a time overlapped sequence. This creates a magnetic field at any point above the coils which remains substantially parallel to the target whilst the field strength decays from a magnetically saturating value to below a strength at which it has significant influence on the condition of the steel strips.

8 Claims, 2 Drawing Sheets

APPARATUS AND METHOD FOR MAGNETISING SECURITY TARGETS

BACKGROUND OF THE INVENTION

This invention relates to apparatus and a method for use with security targets of the type often used in libraries to discourage theft of books. More particularly but not exclusively the invention relates to a method and apparatus to magnetism, such targets as completely as is physically practical, using apparatus which avoids physical constraints which would become inconvenient in libraries Security targets of this type generally define a plurality of magnetizable areas thereon and, in a preferred form, comprise a backing strip of high penetrability and low coercively material, e.g. permolly, with magnetisable areas spaced therealong, said areas normally comprising short strips of magnetisable material such as spring steel. In use, the target is positioned typically on or within the spine of a book.

Security gates for use with this type of target are designed to sound an alarm if a target with fully demagnetised strips is passed through it and are designed not to sound an alarm if the steel strips are magnetised to the point of saturation.

When the target is in an intermediate condition of magnetism a security gate may give a wrong indication, depending on how it has been adjusted. By way of example, an incompletely magnetized target which does not trigger the alarm in the library where it was magnetised may subsequently trigger the alarm in a shop. It is therefore important that targets are thoroughly magnetised.

Previous systems to magnetise security targets have either required the book to be lifted and placed in a machine which partially encloses the book, which has the disadvantage of substantially slowing the task of book issue or return in many cases, or have used a more convenient flat machine over which the book is passed. However, such flat machines either do not fully magnetise the targets, require unreasonable amounts of energy, or function adequately only with a specific target location in the book, other target locations giving consistent problems.

In order to magnetise the security targets fully, it is necessary to magnetise the magnetisable areas by generating a magnetic field along the target.

SUMMARY OF THE INVENTION

An object of the present invention is to magnetise security targets using a flat machine to a standard similar to that produced herebefore by machines which partially enclose the target.

According to one aspect of this invention, there is provided apparatus for magnetising a security target of the type defining a plurality of magnetizable areas, wherein a plurality of field coils are provided in a predetermined relationship, and means are provided to energise said coils in a controlled manner to create magnetic conditions sequentially over a magnetic field volume for the target.

Conveniently, the predetermined relationship of the coils is overlapping.

Preferably, for a target comprising a backing strip with magnetisable areas spaced therealong, a multiplicity of field coils are provided in two substantially parallel rows with the coils of one row overlapping the coils of the other row, whereby magnetic fields from overlapped pairs of coils can combine to generate a sufficient strength progressively in a substantially longitudinal direction to magnetise the magnetisable areas of the targets to saturation.

According to another aspect of this invention, a method of magnetising security targets defining a plurality of magnetsable areas, comprises generating magnetic fields sequentially to produce a magnetic field volume for the targets.

BRIEF DESCRIPTION OF THE DRAWINGS

In order that the invention will be readily understood, one presently preferred embodiment thereof will now be described, by way of example with reference to the accompanying drawings in which.

DETAILED DESCRIPTION OF THE PREFERRED EMBODIMENT

Figure 1:
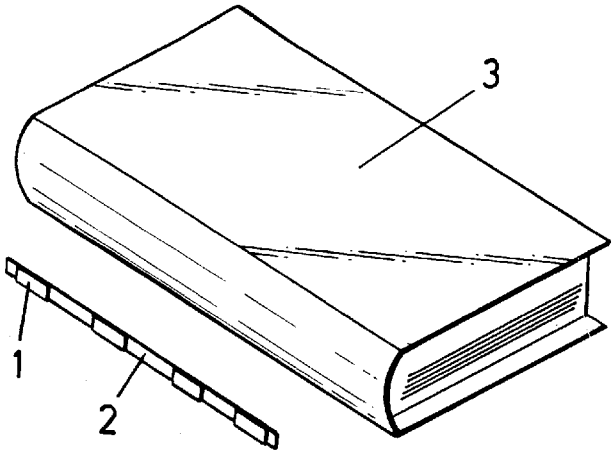
FIG. 1 is a perspective view of a book and security target to be attached thereto.
Figure 2:
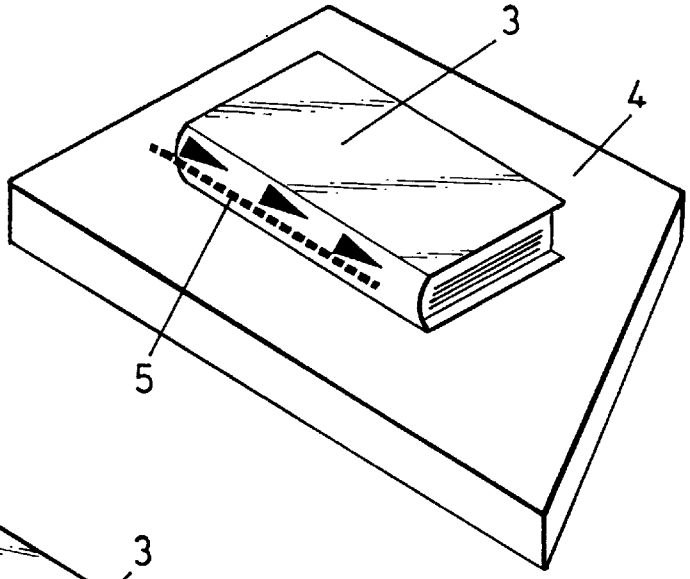
FIG. 2 is a perspective view of the book ready for conditioning.

Referring to FIGS. 1 and 2, as discussed hereinbefore, the security target is of the known type comprising a number of magnetisable strips 1, in this embodiment four spring steel strips, attached at regularly spaced positions along a backing strip 2 of permalloy or similar. The backing strip is generally applied to the spine of a book 3 and, in a preferred flat bed machine system, the book is placed on a flat counter 4 and moved through the magnetic volume suitable to magnetise the target The spine of the book should be aligned in the direction of energisation of the field coils. During the time period when the spine of the book is in the magnetic volume the complete sequence of coil energisation must take place.

Alternatively, the book can be placed on the counter, within the area of the magnetic volume to be produced.

Figure 3:
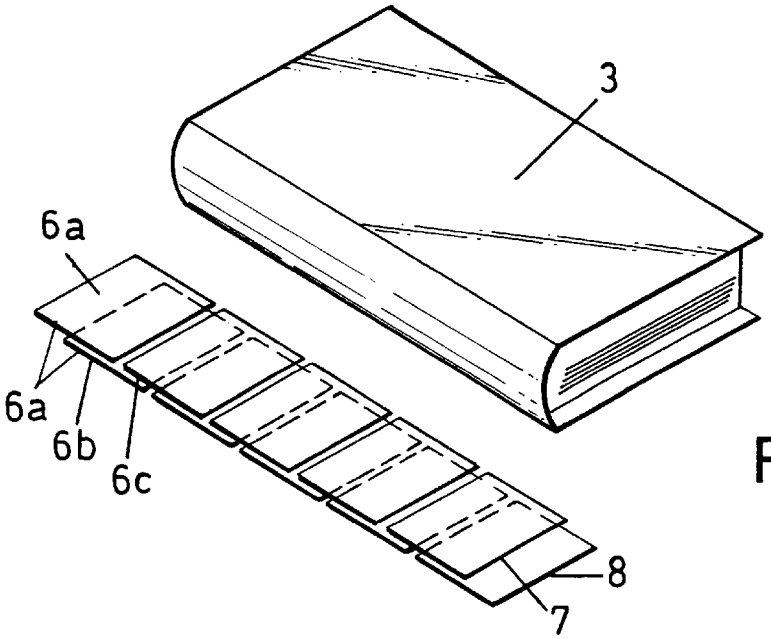
FIG. 3 is a perspective view showing the physical positioning of magnetic field coils.

Referring to FIG. 3, in accordance with the invention, an arrangement for producing the magnetic volume field 5 comprises a plurality of field coils 6, in this embodiment ten, which are overlapped on a pitch equal to half their outer diameter and are positioned evenly in parallel lower and upper rows 7 and 8 so that they interleave.

Figure 4:
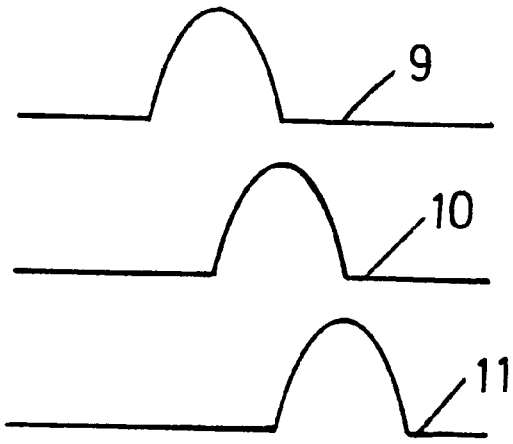
FIG. 4 shows sample waveforms of current in the field coils.

Current waveforms of substantially halt sinusoid shape are imposed on the field coils in sequence, as shown in FIG. 4. Although only three waveforms are shown, these are illustrative of the subsequent waveforms to this; thus waveforms 9 represents the current in field coil 6*a*, waveform 10 represents the current in field coil 6*b*, and waveform 11 represents the current in field coil 6*c*.

The phasing of these waveforms is such that, with a small tolerance, the start of conduction in each subsequent field coil coincides with the peak current in the one preceding it. It will thus be appreciated that the field coils 6 are so overlapped that magnetic fields from pairs of coils can combine to meet the requirements for the magnetic field to generate sufficient strength progressively in a substantially longitudinal direction to magnetise the magnetisable strips to saturation.

Figure 5:
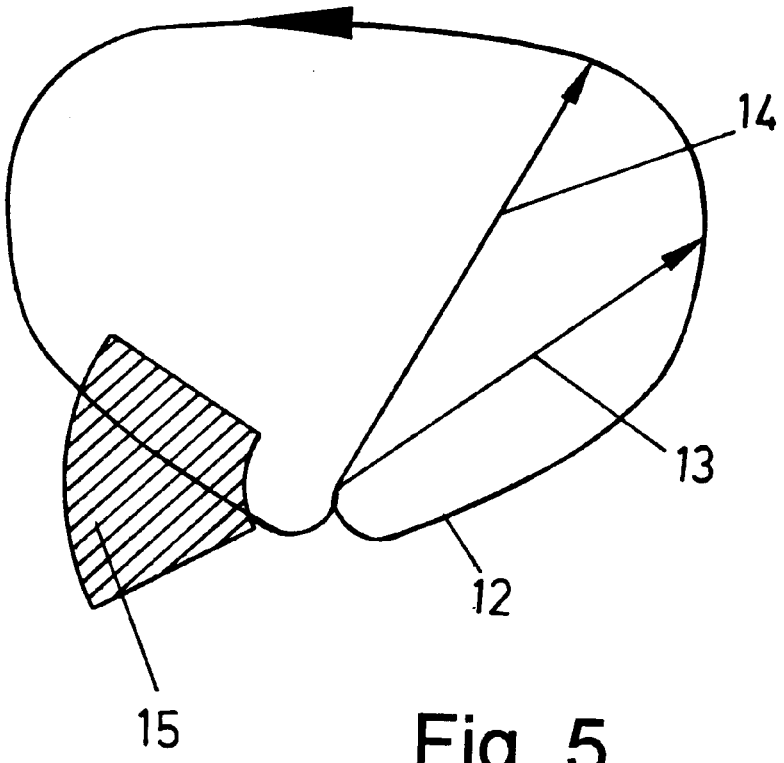
FIG. 5 is a vector-locus diagram of the generated magnetic field at a typical point near the target

Referring to FIG. 5, this shows a plot of the typical magnetic field over time at a point near the target; this field is produced by several coils 6 and is suitable to magnetise that part of the target. The locus line 12 shows a time varying magnetic field vector at such a point, with instantaneous vectors 13 and 14 shown for clarity. The locus passes anti-clockwise from the energisation of the first coil to the de-energisation of the second one. A tolerance zone 15 is shown in the Figure; the outer arc represents the field necessary to saturate the magnetisable strips, and the inner arc represents the field which is too small to alter the magnetization significantly. The radial bounds of this tolerance zone represent the angle over which the field direction can vary without significantly affecting the magnetisaton angle of the magnetisable strips. Thus, in order to guarantee to magnetise a magnetisable strip longitudinally to the point of saturation, and then not impair this subsequently, the locus must pass through the tolerance zone substantially as shown, entering by the outer arc, and leaving by the inner arc as the field decays.

In a modification of the embodiment described, a magnetic core (not shown) may be used in conjunction with the coils 6 to improve the energy efficiency in a manner familiar to those skilled in the art.

An advantage of the arrangement described above is that targets with a greater range of spacing between the magnetic field source and the target can be magnetised compared with prior arrangements; it will be appreciated that, when a target is embedded in a spine and pressed against a right-angled machine it is close to the coil giving the magnetic field, whereas if the target extends along the spine around the middle of a thick book and the book is moved over a flat machine the target is relatively far from the coil.

Another advantage is that the targets can be conditioned using less energy per unit volume of useful magnetising capability then with other arrangements. The corollary of this is that the volume covered by powerful magnetic fields is less than if a single coil unit were used, and this:

(a) reduces the extent to which the arrangement may interfere with adjacent apparatus (b) minimises operator exposure to magnetic fields, in case exposure to magnetic fields should in future be found to be harmful, and (c) minimises energy use per target magnetised.

The arrangement described above also lends itself to use for the demagnetisation of targets, using an alternating and declining magnetic field as known per se.

It will be appreciated that the above embodiment has been described by way of example only and it is to be understood that alternative materials and dimensions and means may be employed, as may be judged appropriate by the person skilled in the art having regard to the scope of the invention as defined by the appended Claims.

What is claimed is:

1. Apparatus for magnetising a security target of the type defining a plurality of magnetisable areas, wherein a plurality of field coils are provided in a predetermined relationship and means are provided to energise said coils in time-overlapped sequence to create magnetic conditions sequentially over a magnetic field volume for the target.

2. Apparatus according to claim 1 wherein the field coils are provided in one or more rows.

3. Apparatus according to claim 2 for a target comprising a backing strip with magnetisable areas spaced therealong, wherein the field coils are provided in two substantially parallel rows with the coils of one row overlapping the coils of the other row, whereby magnetic fields from overlapped pairs of coils can combine to reach a sufficient strength in a substantially longitudinal direction to magnetise the magnetisable areas to saturation.

4. Apparatus according to claim 3, wherein the coils are positioned evenly along said two rows and overlapped on a pitch equal to half their outer diameter.

5. Apparatus according to claim 1, wherein the phasing of the waveforms produced in use is such that conduction in each subsequent coil is initiated substantially at the peak current of its preceding coil.

6. A flat machine for magnetising articles having security targets incorporating apparatus according to claim 1.

7. A flat machine according to claim 6, wherein means are provided for demagnetising said targets.

8. A method of magnetizing security targets of the type defining a plurality of magnetizable areas, comprising generating magnetic fields in time-overlapped sequence to produce a magnetic field volume for the targets.

* * * * *